US008373963B2

(12) United States Patent
Katano

(10) Patent No.: US 8,373,963 B2
(45) Date of Patent: Feb. 12, 2013

(54) ION/OZONE WIND GENERATION DEVICE AND METHOD

(76) Inventor: Akio Katano, Yokohama (JP)

( * ) Notice: Subject to any disclaimer, the term of this patent is extended or adjusted under 35 U.S.C. 154(b) by 0 days.

(21) Appl. No.: 13/521,956

(22) PCT Filed: Jul. 14, 2010

(86) PCT No.: PCT/JP2010/004574

§ 371 (c)(1),
(2), (4) Date: Jul. 12, 2012

(87) PCT Pub. No.: WO2011/092755

PCT Pub. Date: Aug. 4, 2011

(65) Prior Publication Data

US 2012/0300356 A1 Nov. 29, 2012

(30) Foreign Application Priority Data

Jan. 26, 2010 (JP) ..... 2010-014403
Apr. 28, 2010 (JP) ..... 2010-104224

(51) Int. Cl.
*H01T 23/00* (2006.01)
*H05F 3/00* (2006.01)

(52) U.S. Cl. ..... 361/231

(58) Field of Classification Search ..... 361/213, 361/229–231

See application file for complete search history.

(56) References Cited

U.S. PATENT DOCUMENTS

| | | | | |
|---|---|---|---|---|
| 4,812,711 | A * | 3/1989 | Torok et al. | 315/111.91 |
| 5,017,876 | A * | 5/1991 | Wright et al. | 324/464 |
| 7,212,393 | B2 * | 5/2007 | Gefter et al. | 361/230 |
| 8,139,354 | B2 * | 3/2012 | June et al. | 361/679.47 |
| 8,295,026 | B2 * | 10/2012 | Matsuyama | 361/234 |
| 2002/0071235 | A1 * | 6/2002 | Gorczyca et al. | 361/231 |
| 2005/0194583 | A1 * | 9/2005 | Taylor et al. | 257/10 |
| 2008/0130191 | A1 * | 6/2008 | Gefter | 361/231 |

FOREIGN PATENT DOCUMENTS

| | | |
|---|---|---|
| JP | 56-1482 | 1/1981 |
| JP | S63-500059 | 1/1988 |
| JP | 4-35392 | 3/1992 |
| JP | 10-199653 | 7/1998 |
| JP | 2000-082567 | 3/2000 |
| JP | 2002-59027 | 2/2002 |
| JP | 2003-342005 | 12/2003 |
| JP | 2004-18348 | 1/2004 |
| JP | 3100754 | 5/2004 |
| JP | 2005-13831 | 1/2005 |
| JP | 2005-149901 | 6/2005 |
| JP | 2006-26459 | 2/2006 |
| JP | 2007-027070 | 2/2007 |
| JP | 2008-287891 | 11/2008 |
| JP | 3155540 | 11/2009 |

* cited by examiner

*Primary Examiner* — Rexford Barnie
*Assistant Examiner* — Christopher Clark
(74) *Attorney, Agent, or Firm* — Jordan and Hamburg LLP

(57) ABSTRACT

An ion/ozone wind generation device includes an electrode pair including a needle-shaped electrode and an opposite electrode, and generates ions and ion/ozone wind using corona discharge by generating a potential difference between the needle-shaped electrode and the opposite electrode, wherein the opposite electrode includes a plane-shaped main ring-shaped opposite electrode and a plane-shaped sub ring-shaped opposite electrode surrounding the plane-shaped main ring-shaped opposite electrode, and the longest distance between a tip of the needle-shaped electrode and the main ring-shaped opposite electrode is shorter than the shortest distance between the tip of the needle-shaped electrode and the sub ring-shaped opposite electrode.

4 Claims, 6 Drawing Sheets

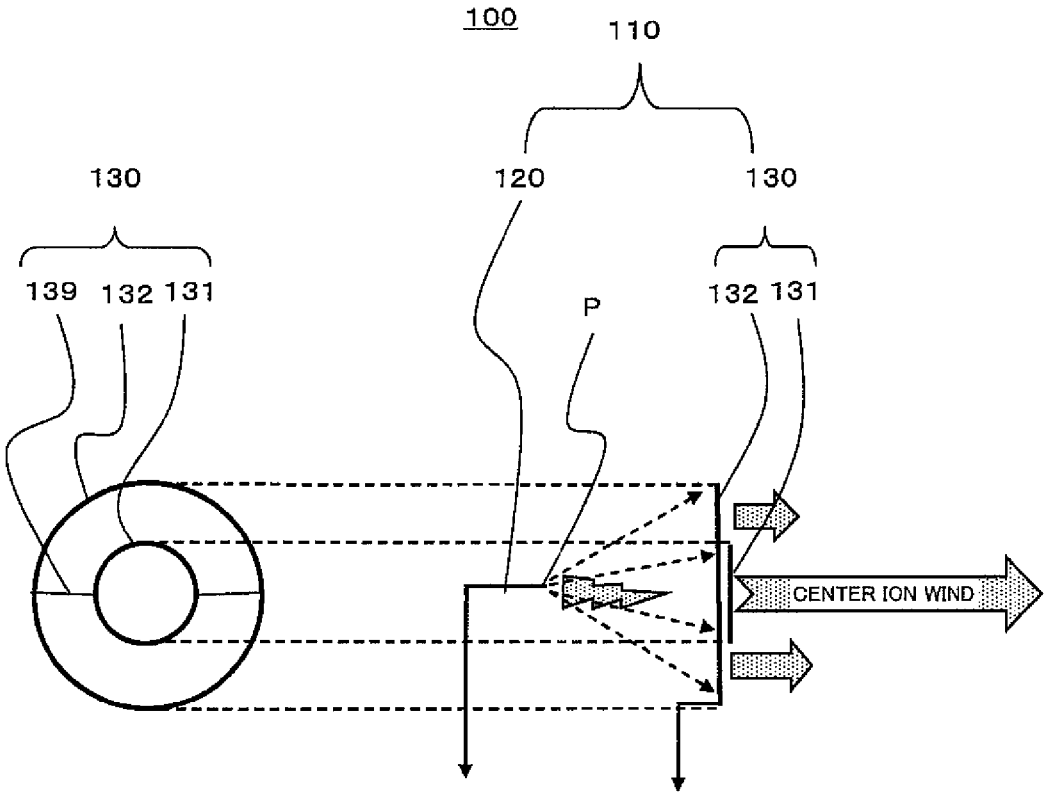
FIG. 1(a)
FIG. 1(b)
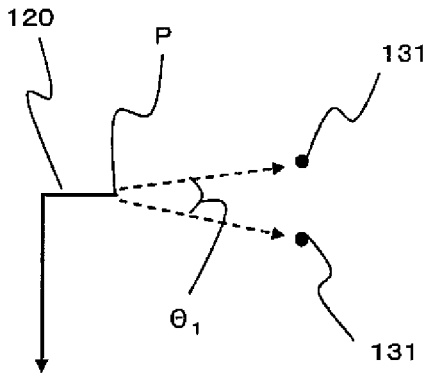
FIG. 2(a)
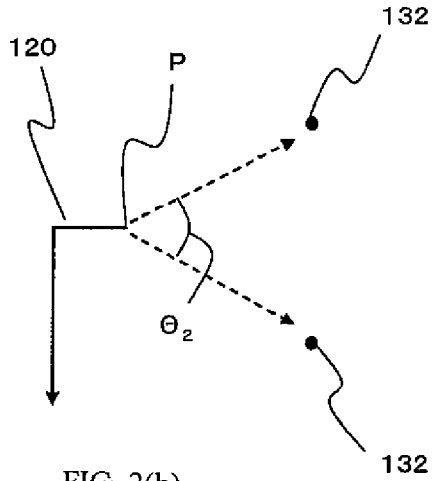
FIG. 2(b)

FIG. 7
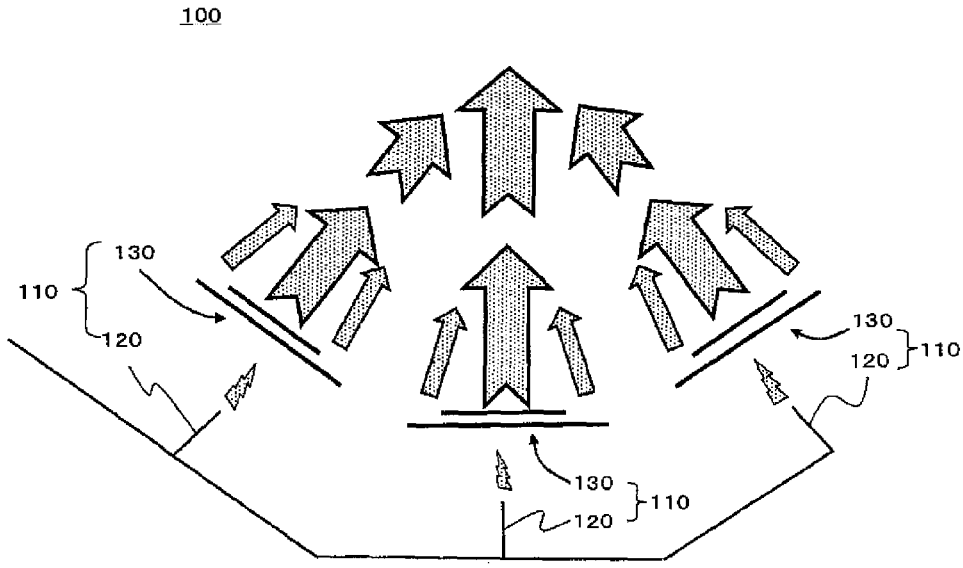
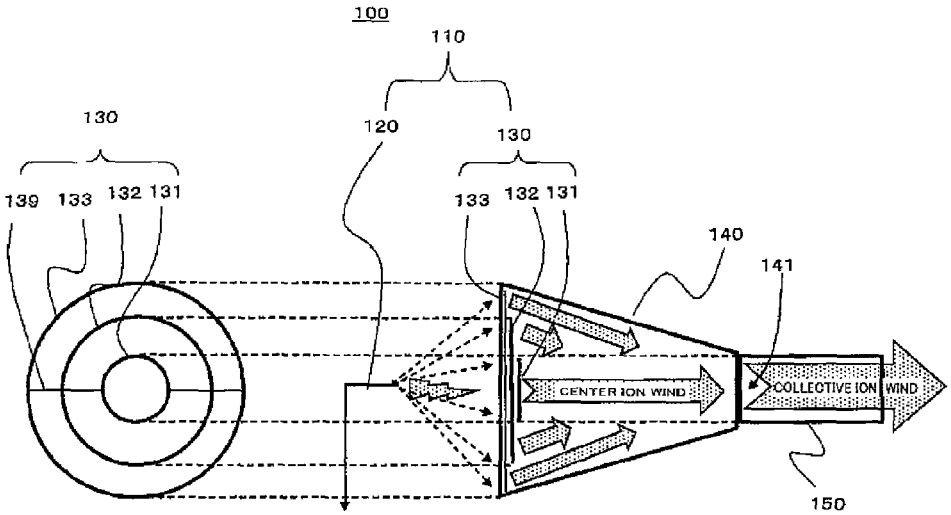
FIG. 8(a) FIG. 8(b)

FIG. 9
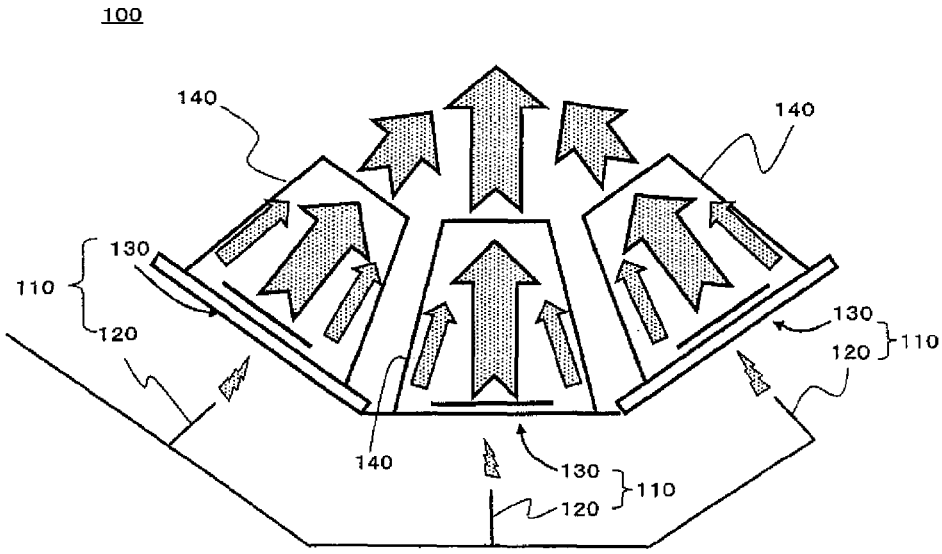
FIG. 10(a)
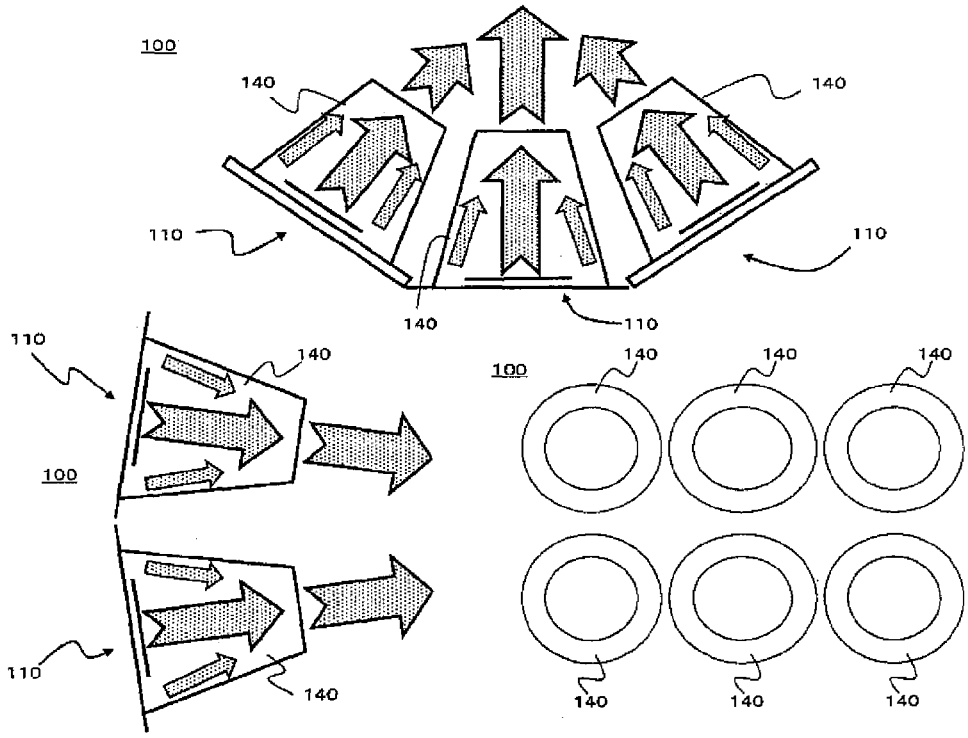
FIG. 10(b) FIG. 10(c)

ION/OZONE WIND GENERATION DEVICE AND METHOD

BACKGROUND OF THE INVENTION

The present invention relates to a device for generating ion wind by corona discharge, and more particularly, to an ion wind generating device that generates a larger volume of ion wind. Further, in a certain aspect, the present invention relates to a device and method for sterilizing/deodorizing a target object such as waste, and in particular, to a device and method for performing corona discharge in a space that is separate from a space in which a target object is placed, generating ions and ozone, supplying ion/ozone wind to the space in which the target object is placed, and sterilizing/deodorizing the target object. More specifically, the present invention relates to an environmental device for sterilizing/deodorizing a target object by being equipped at a high airtight box, for example, a disposal box for garbage, diaper or the like, a box for receiving shoes, boots or a disposed odor of a garbage disposer, a toilet and a toilet tank, a high airtight container equipped with a refrigerating device and a vehicle equipped with a refrigerating device, a refrigerator, an indoor/in-vehicle air conditioner, or the like.

Due to aging of the society, there has been a high demand for a disposal box for diapers and the like in proportion with the population who need nursing care. However, the offensive odor that is released every time the box is opened gives a discomfort or burden to a caregiver and the ambient, and also it is unsanitary. Further, although garbage storage boxes are present in homes and restaurants, since offensive odor caused by growth of bacteria is released every time the boxes are opened, a burden on relevant workers such as housewives is large. As the use of garbage disposer increases due to the development of biotechnology, offensive odor released around the garbage disposer during operation has become a very serious problem. In addition, transportation by transport containers, trucks, and the like are mainly used for foreign/domestic distribution of refrigerated/normal-temperature products, and the like, and there are a number of marine containers/on-land containers/container-type trucks and the like equipped with air conditioners. However, residual odor of loaded products and musty odor in air conditioners have become problematic. Further, air conditioners for storehouses, refrigerators, or indoor/in-vehicle spaces have the problem of offensive odor depending on the usage conditions including stored materials.

As a solution to the above problem, a simplified sterilizer/deodorizer, such as a spray type, has been proposed in the past. However, when such a simplified sterilizer/deodorizer is used in a waste box or a garbage storage box, offensive odor is released when the box is opened. Further, when it is used in an air conditioner (as, for example, dispersive or cyclic sterilization system), the problem is that there is a region, in an air conditioner, incapable of being cleaned; or abnormal odor and musty odor left after cleaning migrate to subsequently loaded products. In addition, as another solution technique, a method of suctioning air from a sterilizing/deodorizing target space and adsorbing or removing contaminated materials by a filter, or an expensive catalyst that removes offensive odor has be proposed. However, maintenance such as replacement of a filter is necessary for long-term use. In addition, in many cases, satisfactory performance may not be obtained because the performance of a filter is insufficient. Even when the filter performance is good, a large and expensive catalyst body and a high maintenance cost are required in many cases.

However, recently, air cleaners and air conditioners for generating negative ions or ozone for cleaning and refreshing indoor air have been introduced. There have been proposed a plurality of technologies for deodorizing a target space by using a negative ion/ozone generating device that simultaneously generates negative ions and ozone that have a deodorizing effect.

First, a negative ion/ozone generating device according to Japanese Utility Model Registration No. 3100754 is designed to be installed on a ceiling of a room and is configured such that a positive electrode is located beneath a negative electrode. According to this configuration, a downstream airflow containing negative ions and ozone can be generated even without using a fan or a motor.

Next, a negative ion/ozone generating device according to Japanese Patent Application Laid-Open (JP-A) No. 2003-342005 includes a cathode electrode having a needle-shaped tip and a cylindrical ground electrode that is concentrically installed in parallel to the cathode electrode, in which the cathode electrode and the ground electrode are relatively movable. A high voltage is applied to the cathode electrode to adjust the distance between the tip portion of the cathode electrode and the end of the ground electrode, thereby generating negative ions or ozone.

Next, a negative ion/ozone generating device according to JP-A No. 2004-18348 applies a high direct voltage between a needle-shaped electrode and an earth electrode to generate corona discharge at the apical portion of the needle-shaped electrode, thereby generating ozone or negative ions.

Next, a negative ion/ozone generating device according to JP-A No. 2005-13831 includes a positive electrode consisting of a metal plate having one or more holes with an erected portion therearound, and a negative electrode having a tip located adjacent to the holes of the positive electrode. With this configuration, since a sufficient airflow is generated by discharge, an air stream capable of diffusing generated negative ions or ozone in a space can be generated even without using a separate blower device such as a fan or a pump.

The inventions according to Japanese Utility Model Registration No. 3100754, Japanese Patent Application Laid-Open (JP-A) No. 2003-342005, JP-A No. 2004-18348 and JP-A No. 2005-13831 describe generating ions and ozone and applying the same to a target object. However, these technologies, for example, assume that the device is placed in a sterilizing/deodorizing target space, such as inside of a trash can, and performs discharge. For example, if in a trash can, an organic matter releasing offensive odor may be resolved by microorganisms to generate flammable gas such as methane gas. When discharge is performed in this state, fire or explosion may occur due to the generation of spark.

Thus, in order to remove such a danger, research is being conducted to develop an external sterilizing/deodorizing device that performs discharge outside a space of a target object, generates ions and ozone, and introduces the generated materials into the space in which the target object is placed (Japanese Utility Model Registration No. 3155540).

SUMMARY OF INVENTION

As with the technology disclosed in Japanese Utility Model Registration No. 3155540, in a device for generating ions and ozone by corona discharge, when a mechanism having a motor such as an air pump is provided, the relevant motor is rusted by the generation of ozone or the like, thus causing a problem in the durability of the device. Thus, an object of the present invention is to provide an ion/ozone wind generating device and method for generating a large volume of ion wind, and an external sterilizing/deodorizing device and method, which can introduce ions and ozone into a space in which a sterilizing/deodorizing target object is placed, even without using an air pump, a fan, or the like.

According to the present invention (1), there is provided an ion/ozone wind generation device including an electrode pair including a needle-shaped electrode and an opposite electrode, and generating ions and ion/ozone wind using corona discharge by generating a potential difference between the needle-shaped electrode and the opposite electrode, in which the opposite electrode includes a plane-shaped main ring-shaped opposite electrode and a plane-shaped sub ring-shaped opposite electrode surrounding the plane-shaped main ring-shaped opposite electrode, and the longest distance between a tip of the needle-shaped electrode and the main ring-shaped opposite electrode is shorter than the shortest distance between the tip of the needle-shaped electrode and the sub ring-shaped opposite electrode.

According to the present invention (2), there is provided the ion/ozone wind generation device recited in the present invention (1), including an ion wind guide member that concentrates ion wind generated from the sub ring-shaped opposite electrode, with respect to ion wind generated from the main ring-shaped opposite electrode of the opposite electrode, and that sends ion wind to an exhaust nozzle which exhausts out ion wind to the outside, in which a cross-sectional area of the opening of the ion wind guide member decreases toward the exhaust nozzle.

According to the present invention (3), there is provided the ion/ozone wind generation device recited in the present invention (1) or (2), in which the electrode pair is provided in plurality.

The respective terms used herein will now be described. A "sterilizing/deodorizing target object" is not particularly limited as long as it breeds bacteria or release offensive odor. Examples of the sterilizing/deodorizing target object include raw garbage such as fresh food, manures, waste materials such as diapers, and water in a reservoir. A "space in which a sterilizing/deodorizing target object is placed" is not particularly limited as long as the space includes a sterilizing/deodorizing target object. Examples of the space of a sterilizing/deodorizing target object include a high-airtight box, more particularly, a disposal box for raw garbage or diaper, a high-airtight container equipped with a refrigerating device, and a vehicle equipped with a refrigerating device. "Ring-shaped" refers to, for example, a polygonal shape having three or more vertices (preferably, six or more), a circular shape, or a substantially circular shape, and refers to a shape with a center opening. "Plane-shaped" refers to a shape of a ring-shaped electrode that can be generally regarded as a plane because the thickness is relatively smaller with respect to the total area in a ring. More specifically, without limitation, [Thickness (mm)]/[Total area in a ring ($cm^2$)] is preferably 1.5 or less, preferably 1 or less, and more preferably 0.8 or less. Without limitation, the lower limit value is, for example, 0.0001. Further, a distortion (distortion on a plane) up to a degree of a thickness may be allowed. More specifically, it is more preferable that the total area of a main ring-shaped opposite electrode be 7 $cm^2$ or less, the thickness 7 mm or less, and the distortion 7 mm or less. The "longest distance between a tip of the needle-shaped electrode and the main ring-shaped opposite electrode" refers to the longest distance between the tip of the needle-shaped electrode and the portion of the main ring-shaped opposite electrode that is an inner side end of the ring and is nearest in the thickness direction. The "shortest distance between a tip of the needle-shaped electrode and the sub ring-shaped opposite electrode" refers to the shortest distance between the tip of the needle-shaped electrode and the portion of the sub ring-shaped opposite electrode that is an inner side end of the ring and is nearest in the thickness direction. "Main ion wind" refers to ion wind generated from an opening portion at the center of the main ring-shaped opposite electrode. "Sub ion wind" refers to ion wind generated from the sub ring-shaped opposite electrode.

According to an ion/ozone wind generating device of the present invention, a large volume of ion wind can be generated, and also it can be used as a replacement for a blower mechanism such as an air pump or a fan.

According to the present invention, ion wind of a relatively high wind pressure is generated from a main ring-shaped opposite electrode, and ion wind of a relatively low wind pressure is generated from a sub ring-shaped opposite electrode surrounding the main ring-shaped opposite electrode. Accordingly, without detaining the generated ion wind, the ion wind generated from the inside can circumvolutes the ion wind generated from the outside to be pushed to the front side, so that a large volume of ion wind of a high wind pressure can be obtained.

With respect to the ion wind of a relatively high wind pressure generated from the main ring-shaped opposite electrode, the ion wind of a relatively low wind pressure is generated from the sub ring-shaped opposite electrode, so that the ion wind generated from the sub ring-shaped electrode supports the ion wind generated from the main ring-shaped opposite electrode. That is, since the ion wind generated from the main ring-shaped opposite electrode is ion wind generated in tailwind, a large volume of strong wind can be obtained.

Further, since an ion wind generating device according to the present invention can generate ions and ozone having a sterilizing/deodorizing function by corona discharge, it is preferable that the ion wind generating device be used as a sterilizing/deodorizing device. According to the present device, a large volume of ion wind can be generated. Even in the case of an external sterilizing/deodorizing device, ions and ozone can be introduced into a target space without using a mechanism such as an air pump. That is, since a pump or a fan need not be used, a low-noise sterilizing/deodorizing device can be provided.

In addition, since the ion wind generated from the sub ring-shaped opposite electrode can be circumvoluted, ions and ozone generated from these electrodes can be circumvoluted. Therefore, since ion wind containing high-concentration ions and ozone can be sent out, high-efficiency deodorization can be achieved.

BRIEF DESCRIPTION OF DRAWINGS

FIG. 1(*a*) is a conceptual front view of an opposite electrode of a relevant device, and FIG. 1(*b*) is a conceptual side view of an ion/ozone wind generation device 100.

FIG. 2(*a*) is a diagram illustrating a positional relation between a ring-shaped electrode 131 and a tip portion P of a needle-shaped electrode 120 by using a cross section of the ring-shaped electrode 131 located at the innermost, and FIG. 2(*b*) is a diagram illustrating a positional relation between a ring-shaped electrode 132 and the tip P.

FIG. 7 is a conceptual plan view of an ion/ozone wind generation device 100.

FIG. 8(*a*) is a conceptual front view of an opposite electrode 130 of a relevant device, and FIG. 8(*b*) is a conceptual side view of an ion/ozone wind generation device 100.

FIG. 9 is a conceptual plan view of an ion/ozone wind generation device 100.

FIG. 10(*a*) is a conceptual plan view of an ion/ozone wind generation device, FIG. 10(*b*) is a conceptual side view of an ion/ozone wind generation device, and FIG. 10(*c*) is a conceptual front view of an ion/ozone wind generation device viewed from an exhaust nozzle.

DETAILED DESCRIPTION OF THE INVENTION

Figures 3A, 3B:
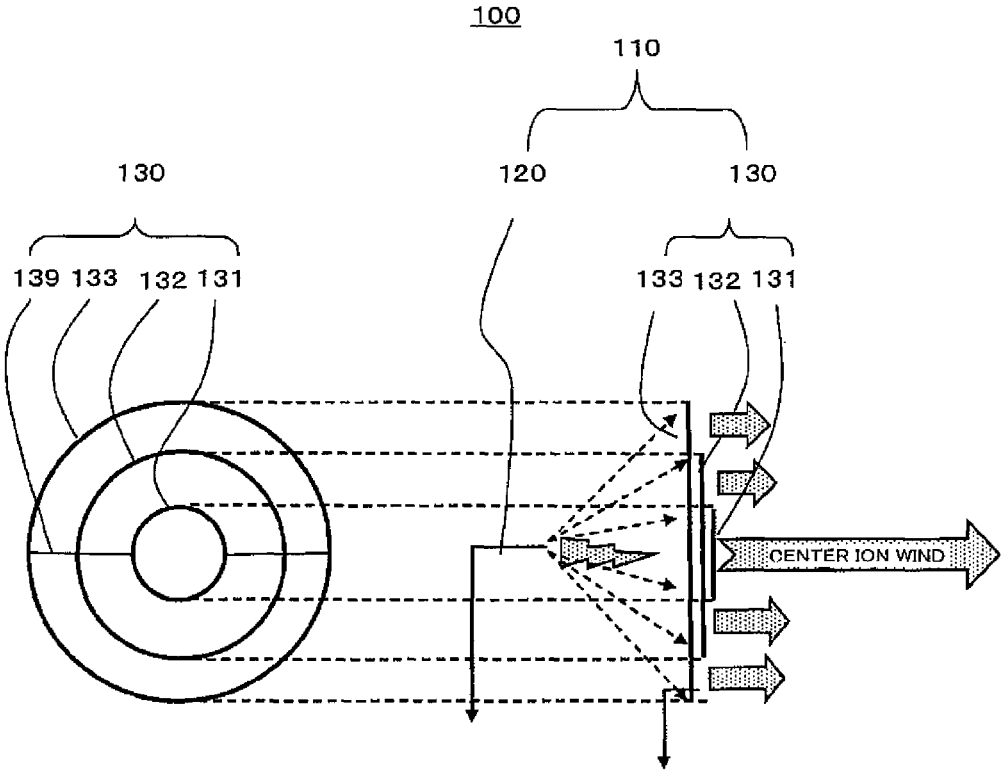
FIG. 3(*a*) is a conceptual front view of an opposite electrode 130 of a relevant device, and FIG. 3(*b*) is a conceptual side view of an ion/ozone wind generation device 100.

An ion/ozone wind generation device according to the present invention includes an electrode pair including a needle-shaped electrode and an opposite electrode, and generates ions and ion/ozone wind using corona discharge by generating a potential difference between the needle-shaped electrode and the opposite electrode. Further, in the ion/ozone wind generation device according to the present invention, the opposite electrode includes a plane-shaped main ring-shaped opposite electrode and a plane-shaped sub ring-shaped opposite electrode surrounding the plane-shaped main ring-shaped opposite electrode, wherein the longest distance between a tip of the needle-shaped electrode and the main ring-shaped opposite electrode is shorter than the shortest distance between the tip of the needle-shaped electrode and the sub ring-shaped opposite electrode.

A large volume of ion wind can be obtained by such a configuration. In the case of a simple cylinder-shaped or plane circle-shaped opposite electrode, since a donut-shaped ion wind is generated by generating discharge in the shape of a donut along the inside of a plane circle-shaped electrode or the inside of a cylinder-shaped electrode that are opposite and are located at the minimum distance, a center portion of the donut of an ion wind center is in a windless state. Therefore, the ion wind is weakened as a result of the existence of a loss using energy by which the generated ion wind guides wind to a windless center portion. As with the present invention, a relevant problem can be solved by proving a main circle-shaped opposite electrode and a sub circle-shaped opposite electrode.

An ion/ozone wind generation device according to the present invention includes an electrode pair including a needle-shaped electrode and an opposite electrode, and generates ions/ozone and ion wind using corona discharge by generating a potential difference between the needle-shaped electrode and the opposite electrode. Further, the ion wind is generally considered as an airflow that is generated from the needle-shaped electrode to the opposite electrode when ions emitted from the needle-shaped electrode during the corona discharge repeat a collision with air molecules while migrating to the opposite electrode. That is, the ion wind is an airflow that is generated along the flow direction of ions generated during the discharge. A detailed structure of an ion/ozone wind generation device according to the present invention will be described below.

A schematic configuration of an ion/ozone wind generation device according to the present invention is illustrated in FIG. 1. Herein, FIG. 1(*a*) is a conceptual front view of an opposite electrode of a relevant device, and FIG. 1(*b*) is a conceptual side view of an ion/ozone wind generation device 100. The ion/ozone wind generation device 100 according to the present embodiment includes an electrode pair 110 including a needle-shaped electrode 120 and an opposite electrode 130. Herein, the opposite electrode 130 includes a circular ring-shaped electrode 131 that is located at the innermost position placed on an extended line axis of the needle-shaped electrode 120, and an outer circular ring-shaped electrode 132 that is placed on the same axis as the relevant electrode and has a different radius therefrom. That is, these circular ring-shaped electrodes are perpendicular to a ring-shaped plane, and also are placed on an axis passing through a center of the relevant ring (a circle center). When such a circular ring-shaped opposite electrode among the ring-shaped opposite electrodes is used, a discharge unevenness is reduced since distances from a tip of the needle-shaped opposite electrode to each position of the opposite electrode are approximately equal. Further, since the needle-shaped electrode is placed on an axis of the ring, ion wind generated from the main ring-shaped opposite electrode is particularly strengthened.

These ring-shaped electrodes 131 and 132 are preferably bridged by a connection member, such as a bridge 139, so that a current can flow therebetween. With such a configuration, the respective ring-shaped electrodes can be equipotential, and also a positional relation between these electrodes can be easily adjusted. For example, when connected by a wave-shaped member, a substantially triangular shape is formed between the main ring-shaped opposite electrode and the sub ring-shaped opposite electrode. Accordingly, unevenness is generated in corona discharge and a large volume of ion wind is not pushed to the front side. Therefore, in order not to obstruct the generation of ion wind, the connection member is preferably placed such that a conceptual straight line connecting a junction between the connection member and the sub ring-shaped opposite electrode and a junction between the connection member and the main ring-shaped opposite electrode passes through the center of the main ring-shaped opposite electrode. With such a connection, uneven generation of the ion wind caused by a. discharge unevenness is hardly generated.

The main ring-shaped opposite electrode and the sub ring-shaped opposite electrode constituting the opposite electrode may preferably be placed on the same plane. Since the distance gradually weakens discharge efficiency of the sub ring-shaped opposite electrode rather than the main ring-shaped opposite electrode, the relevant distance may be easily changed by placing them on the same plane, which is preferable. Further, in a three-dimensional respect, even if a distance ratio is correct, for example, in the case of a dome shape and the like, the efficiency of ion wind is degraded since the generation direction of the ion wind is not parallel to straight wind generated by the main ion wind.

Further, the needle-shaped electrode 120 and the opposite electrode 130 are respectively connected to a voltage applying unit or a ground, discharge is generated by generating a potential difference between the relevant electrodes in use. Herein, it is preferable that a positional relation between a tip portion P of the needle-shaped electrode 120 and the innermost main ring-shaped opposite electrode 131 be most suitable for generating ion wind. By placing them at such a distance, since it becomes a small-radius ring-shaped opposite electrode located more central than the opposite electrode, relatively strong ion wind is generated and thus a large volume of ion wind can be obtained. In the event of such a positional relation, the ring-shaped opposite electrodes may be placed on the same plane, and may be placed on separate planes. Further, dashed arrows illustrated from the tip portion P to the ring-shaped opposite electrode in the drawings represent the migration direction of ions caused by corona discharge.

A positional relation suitable for generating ion wind will be described by using a pattern diagram of FIG. 2. FIG. 2(*a*) illustrates a positional relation between the ring-shaped opposite electrode 131 and a tip portion P of the needle-shaped electrode 120 by using a cross section of the ring-shaped opposite electrode 131 located at the innermost, and FIG. 2(*b*) illustrates a positional relation between a ring-shaped opposite electrode 132 and the tip portion P.

First, if it is in a positional relation between the tip portion P and the ring-shaped opposite electrode 131, ions migrate toward the electrode along the directions of arrows. That is, theoretically, ion wind is generated at an angle of $\theta_1$ from the tip portion P. Therefore, in general, ion wind is generated in the direction of a bus line connecting an apex of a cone being an apex of the tip portion P and a bottom end. That is, ion wind is also generated toward the outside direction of the ring-shaped opposite electrode, but in general, the ion wind is pushed out mainly toward the front direction from the center of the ring-shaped opposite electrode. On the other hand, in the case of a ring-shaped electrode having a relatively large radius like the ring-shaped opposite electrode 132 illustrated in FIG. 2(*b*), theoretically, ion wind is generated at an angle of $\theta_2$ from the tip portion P. That is, since the relevant angle is increased, a large volume of ion wind derived from this electrode is pushed toward the outside direction of the ring-shaped opposite electrode, and a small amount of the ion wind is pushed out toward the front direction.

Further, corona discharge is apt to be generated with respect to the opposite electrode located near the needle-shaped electrode. As the ring-shaped opposite electrode is located closer to the center, the distance from the tip P of the needle-shaped electrode is shorter. That is, since the probability of corona discharge generation is higher in the ring-shaped opposite electrode located at the center, the absolute wind pressure of ion wind generated is higher in the ring-shaped opposite electrode located at the center.

As described above, the innermost ring-shaped opposite electrode 131 is advantageous in terms of the direction of ion wind generation, and in addition, the absolute wind pressure of ion wind is also high. Therefore, the opposite electrode as illustrated in FIG. 1 is placed such that ion wind generated from the ring-shaped opposite electrode is strengthened as the radius of the ring-shaped electrode is reduced. With such a placement, it is not detained by the ion wind generated from an external electrode, and it is circumvoluted by the ion wind generated from the center. Therefore, the volume of ion wind increases, and also ions and ozone generated by discharge can be pushed to the front side by the ion wind. Accordingly, the sterilizing/deodorizing effect is also increased. Further, it is more preferable that the distance between the innermost ring-shaped opposite electrode 131 and the tip P is maintained at a distance at which corona discharge is apt to be best generated. However, when the diameter of a ring-shaped portion of the opposite electrode is increased, a discharge reaction is generated greatly but is generated in the shape of a donut. Therefore, when an opposite electrode portion is not provided at a ring-shaped center of the opposite electrode, a windless center portion is also increased and thus a discharge unevenness is generated to generate donut-shaped ion wind. Accordingly, since the outer periphery and the center of the generated ion wind becomes a windless state and thus the donut-shaped ion wind guides wind to a windless region, strong wind is not generated. When the diameter of the ring-shaped portion is small, ion wind having a high wind pressure is generated but a generated amount thereof is small. Therefore, the sub ring-shaped opposite electrode being the secondary electrode is placed at the outer periphery of the main ring-shaped opposite electrode, so that mainstream wind having a small diameter and a high wind pressure is generated at the center while substream wind having a large diameter and a low wind pressure is generated at the outer periphery. That is, the opposite electrode according to the present invention satisfies both of the high wind pressure and the large volume of ion wind generated at the same potential, which solves the existing problem that a wind pressure is low and a wind volume is large when a diameter is large, and a wind pressure is high and a wind volume is small when a diameter is small.

When the opposite electrode is formed in the shape of a plane, the ion wind generated from the opposite electrode is not decelerated by the reaction between the ion wind and an obstacle such as a wall surface, and main ion wind generated from the main ring-shaped opposite electrode and sub ion wind generated from the sub ring-shaped opposite electrode are combined immediately. Therefore, since the main ion wind can rapidly obtain a synergy effect caused by tailwind by the surrounding sub ion wind immediately after the generation, a larger volume of ion wind can be obtained. Further, when the opposite electrode is formed in the shape of a plane, the opposite electrode can be easily cleaned.

In the ion/ozone generating device according to the present invention, the longest distance between the tip of the needle-shaped electrode and the main ring-shaped opposite electrode is shorter than the shortest distance between the tip of the needle-shaped electrode and the sub ring-shaped opposite electrode. When the needle shaped electrode and the opposite electrode are placed in such a distance relation, ion wind having the highest wind pressure is generated from an opening portion formed at the center of the main ring-shaped opposite electrode and ion wind having a low wind pressure is generated from the surrounding sub ring-shaped opposite electrode, so that a large volume of ion wind can be obtained. When deviating from the positional relation between the needle-shaped electrode and the ring-shaped electrode, ion wind is generated mainly from the space between the main ring-shaped opposite electrode and the sub ring-shaped opposite electrode. Accordingly the ion wind becomes even wind and, therefore, ion wind emitted to the air is weakened. In addition, a reaction is also generated when a guide member is provided.

The number of ring-shaped opposite electrodes constituting the opposite electrode 130 is not limited to two as illustrated in FIG. 1, and a plurality of ring-shaped opposite electrodes, for example, ring-shaped opposite electrodes 131 to 133 as illustrated in FIG. 3, may be provided. Further, FIG. 3(*a*) is a conceptual front view of an opposite electrode 130 of a relevant device, and FIG. 3(*b*) is a conceptual side view of an ion/ozone wind generation device 100. Herein, although a description is given of the case of using three ring-shaped opposite electrodes, any number of ring-shaped opposite electrodes constituting the opposite electrode may be provided as long as they satisfies the distance relation with the needle-shaped electrode. By providing a plurality of electrodes as described above, even when one of the electrodes is contaminated and unable to generate discharge, the discharge can be generated by another electrode, thus improving the operational stability of the device.

Figures 4A, 4B:
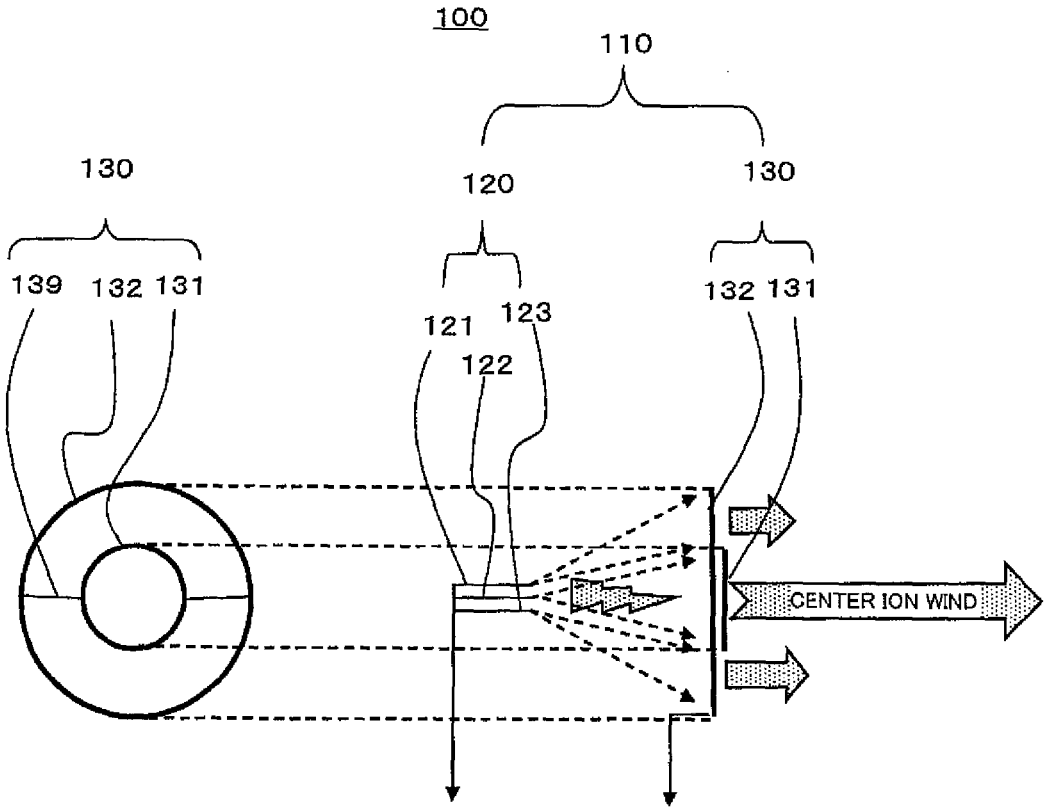
FIG. 4(*a*) is a conceptual front view of an opposite electrode of a relevant device, and FIG. 4(*b*) is a conceptual side view of an ion/ozone wind generation device 100.

As illustrated in FIG. 4, a plurality of needle-shaped electrodes, for example, needle-shaped electrodes 121 to 123, may be provided. In this case, all of the needle-shaped electrodes and the opposite electrodes are placed such that the longest distance between the tip of the needle-shaped electrode and the main ring-shaped opposite electrode is shorter than the shortest distance between the tip of the needle-shaped electrode and the sub ring-shaped opposite electrode. Further, FIG. 4(*a*) is a conceptual front view of an opposite electrode of a relevant device, and FIG. 4(*b*) is a conceptual side view of an ion/ozone wind generation device 100. When a plurality of needle-shaped electrodes are provided as described above, the pushing capability is increased due to the high possibility of a molecule collision caused by the frequent occurrence of a dielectric breakdown. Accordingly, a larger amount of ozone can be generated as compared to the case of a single polarity.

Figures 5A, 5B:
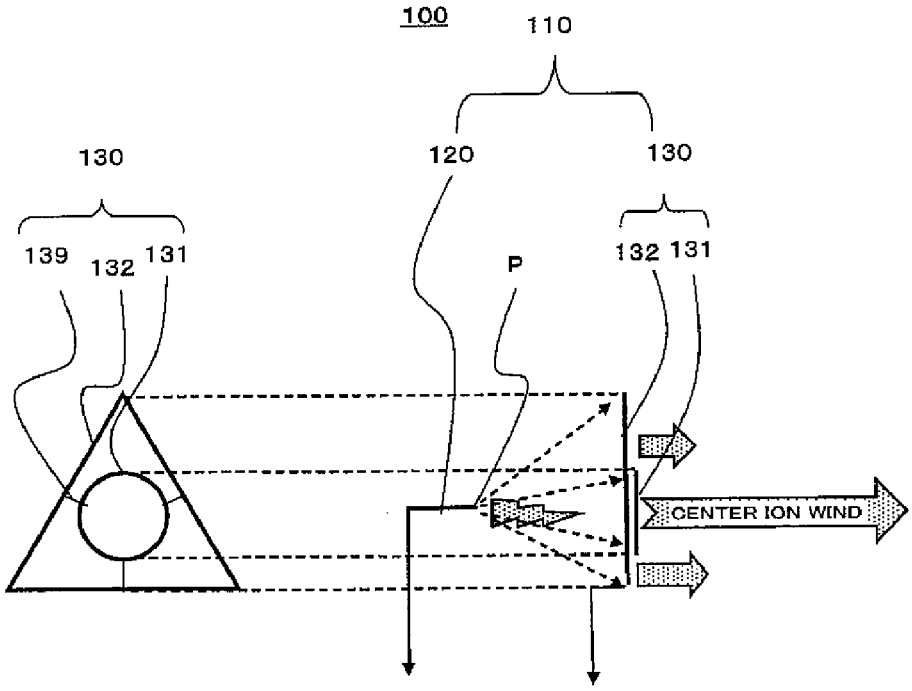
FIG. 5(*a*) is a conceptual front view of an opposite electrode of a relevant device, and FIG. 5(*b*) is a conceptual side view of an ion/ozone wind generation device 100.

As illustrated in FIG. 5, the opposite electrode according to the present invention may be polygonal. Further, in this case, each of the needle-shaped electrodes and the opposite electrodes is placed such that the longest distance between the tip of the needle-shaped electrode and the main ring-shaped opposite electrode is shorter than the shortest distance between the tip of the needle-shaped electrode and the sub ring-shaped opposite electrode. Further, FIG. 5(*a*) is a conceptual front view of an opposite electrode of a relevant device, and FIG. 5(*b*) is a conceptual side view of an ion/ozone wind generation device 100. Even when the opposite electrode is triangular, a large volume of ion wind can be obtained since the volume of ion wind generated from the main ring-shaped opposite electrode is smaller than the volume of ion wind generated from the sub ring-shaped opposite electrode. Further, although the main ring-shaped opposite electrode is illustrated as being a circular shape herein, it may be a polygonal shape having three or more vertices. Further, when the opposite electrode is polygonal, it has an advantage that a discharge unevenness is hardly generated because the number of points having the shortest distance from the needle-shaped electrode increases as the number of sides increases.

Figures 6A, 6B, 6C, 6D:
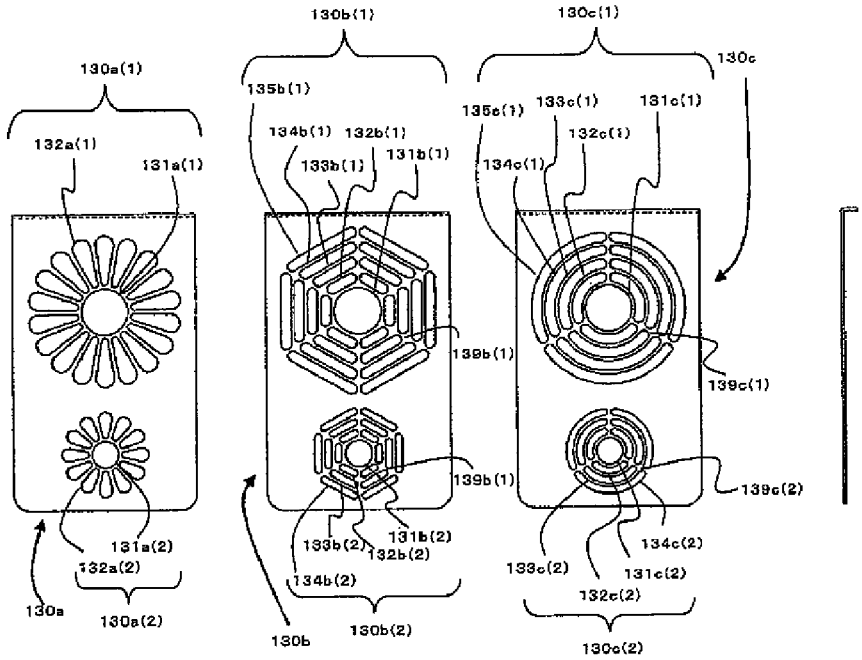
FIG. 6 is a schematic view of a plate-shaped opposite electrode which is usable as an opposite electrode according to the present invention.

FIG. 6 is a schematic view illustrating an example of an opposite electrode according to the present invention. Herein, a hole is provided at a plate to form an opposite electrode. FIG. 6(*c*) is a conceptual view of a plate-shaped opposite electrode 130*c* having a ring-shaped opposite electrode. The relevant opposite electrode includes a first opposite electrode 130*c* (1) and a second opposite electrode 130*c* (2). In the first opposite electrode 130*c*(1), a circle-shaped main ring-shaped opposite electrode 131*c*(1) is formed at a center thereof, a circle-shaped sub ring-shaped opposite electrode 132*c*(1) is formed at a periphery thereof, and sub ring-shaped opposite electrodes 133*c*(1), 134*c*(1) and 135*c*(1) are formed at an outer periphery of the sub ring-shaped opposite electrode 132*c*(1). Further, a connection member 139*c*(1) is formed between these opposite electrodes. Further, likewise, in the second opposite electrode, a circle-shaped main ring-shaped opposite electrode 131*c*(2) is formed at a center thereof, a circle-shaped sub ring-shaped opposite electrode 132*c*(2) is formed at a periphery thereof, and sub ring-shaped opposite electrodes 133*c*(2) and 134*c*(2) are formed at an outer periphery of the sub ring-shaped opposite electrode 132*c*(2). Further, a connection member 139*c*(2) is formed between these opposite electrodes. With respect to these plate-shaped opposite electrodes, a needle-shaped electrode is placed and used at a suitable position.

FIG. 6(*b*) is a view illustrating a schematic configuration of a plate-shaped opposite electrode 130*b*. In the plate-shaped opposite electrode 130*b*, a main ring-shaped opposite electrode is in a circular shape, and a surrounding sub ring-shaped opposite electrode is in a hexagonal shape. The plate-shaped opposite electrode 130*b* includes a first opposite electrode 130*b*(1) and a second opposite electrode 130*b*(2). A circle-shaped main ring-shaped opposite electrode 131*b*(1) is formed at a center of the first opposite electrode 130*b*(1), a hexagon-shaped sub ring-shaped opposite electrode 132*b*(1) is formed at a periphery thereof, and sub ring-shaped opposite electrodes 133*b*(1), 134*b*(1) and 135*b*(1) are formed at an outer periphery thereof. Further, these opposite electrodes are connected via a connection member 139*b*(1).

Likewise, a circle-shaped main ring-shaped opposite electrode 131*b*(2) is formed at a center of the second opposite electrode 130*b*(2), hexagon-shaped sub ring-shaped opposite electrodes 132*b*(2) to 134*b*(2) are formed at a periphery thereof, and these electrodes are connected via a connection member 139*b*(2).

FIG. 6(*a*) is a view illustrating a schematic configuration of a plate-shaped opposite electrode 130*a*. In the plate-shaped opposite electrode 130*a*, a circle-shaped main ring-shaped opposite electrode is formed, and a ring-shaped sub ring-shaped opposite electrode is formed at a periphery thereof. The plate-shaped opposite electrode 130*a* includes a first opposite electrode 130*a*(1) and a second opposite electrode 130*a*(2). A circle-shaped main ring-shaped opposite electrode 131*a*(1) is formed at a center of the first opposite electrode 130*a*(1), and a plurality of sub ring-shaped opposite electrodes 132*a*(1) are formed at a periphery thereof. In FIG. 6(*a*), a typical example of the sub ring-shaped opposite electrode 132*a*(1) is illustrated, but an electrode 132*a*(1) formed around the main ring-shaped opposite electrode 131*a*(1) is also a sub ring-shaped opposite electrode. With such a formation, since a member formed between the sub ring-shaped opposite electrodes is radially extended from the main ring-shaped opposite electrode, in addition to ion wind generated from the main ring-shaped opposite electrode, the volume of ion wind successively decreases as being away from the relevant main ring-shaped opposite electrode. Like the first opposite electrode, the second opposite electrode 132*a*(2) includes a main ring-shaped opposite electrode 131*a*(2) at a center thereof and a sub ring-shaped opposite electrode 132*a* (2).

Further, FIG. 6(*d*) is a common side view of the plate-shaped opposite electrodes 130*a* to 130*c*.

As illustrated in FIG. 7, an ion/ozone wind generation device having a plurality of electrode pairs 110 according to the present embodiment is preferable. Further, FIG. 7 is a conceptual plan view of an ion/ozone wind generation device 100. It is preferable that two electrodes pairs are placed at the left and right sides of an electrode pair located at the center, and the ion wind generation directions of the two left and right electrode pairs intersect with the ion wind generation direction of the center electrode pair. Further, it is more preferable to have an arrangement where the ion wind generated from each electrode pair is concentrated on one point. By using such a device, the ion winds generated from the respective electrode pairs can be merged, and thus a larger volume of ion wind can be obtained.

As illustrated in FIG. 8, it is preferable that a truncated cone-shaped ion wind guide member 140 is provided. Further, FIG. 8(*a*) is a conceptual front view of an opposite electrode 130 of a relevant device, and FIG. 8(*b*) is a conceptual side view of an ion/ozone wind generation device 100. With respect to the ion wind generated from the ring-shaped opposite electrode 131 located at the innermost of the opposite electrode 130, the ion wind generated from the ring-shaped opposite electrode located at the outer side is concentrated (merged) and sent to an ion wind exhaust nozzle 141. As a result, the volume of ion wind pushed to the front side is increased. Further, even when such a guide member is provided, since the ion wind generated at the outer side is smaller than the ion wind generated at the innermost, it is not detained and is pushed to the front side as if suctioned into the center ion wind. The guide member has a shape in which its open cross-sectional area decreased gradually. When such a guide member is provided, the cross-sectional area is reduced with respect to a blowing operation in a case where the ion wind generated from the opposite electrode is even wind or donut wind that does not generate a wind pressure at the center. Therefore, straight ion wind collides against an inner wall of the guide member to generate turbulence, thereby generating a reaction in the inside of the guide member that weakens the wind. However, when the main ion wind is strong and the sub ion wind is weak, the sub ion wind is weak even when the diameter of the guide member is reduced. Therefore, a collision against the inner wall of the guide member is also weakened naturally, the main ion wind circumvolutes the sub ion wind, thereby the ion wind is concentrated and exhausted to the outside.

Further, it is preferable that a blower path 150 is provided in the exhaust nozzle 141 of the guide member 140. Herein, the blower path is not specifically limited as long as it can adjust the direction of ion wind exhausted out. However, it is preferable that the blower path is a cylindrical member having the same diameter as the exhaust nozzle 141. Herein, the material of the blower path is not specifically limited, and may be a hose, vinyl chloride pipe, or the like. As will be described below, when a plurality of electrode pairs are provided, the relevant blower path may be used to easily concentrate the ion wind generated from these electrode pairs. Further, when the relevant electrode pair is used in singularity, ions and ozone may be sent out by the relevant blower path to a sterilizing/deodorizing target space.

As illustrated in FIG. 9, it is preferable to provide a plurality of electrode pairs 110 provided with such guide members 140. When three electrode pairs 110 are provided, two electrodes pairs are placed at the left and right sides of an electrode pair located at the center, and the ion wind generation directions of the two left and right electrode pairs respectively intersect with the ion wind generation direction of the center electrode pair. Further, it is preferable to have an arrangement where the ion wind generated from each electrode pair is concentrated on one point. With such a configuration, the ion winds generated from the respective electrode pairs can be merged, and thus a larger volume of ion wind can be obtained.

As illustrated in FIG. 10, it is preferable that six electrode pairs 110 provided with a guide member 140 (herein, a needle-shaped electrode is not shown for the simplicity of illustration) are provided. FIG. 10(*a*) is a conceptual plan view of an ion/ozone wind generation device, FIG. 10(*b*) is a conceptual side view of the ion/ozone wind generation device, and FIG. 10(*c*) is a conceptual front view of the ion/ozone wind generation device seen from an exhaust nozzle. In this case, a two-stage configuration where a group of three electrode pairs is provided on top and bottom stages, the top and bottom stages are placed according to the placement method in the above-illustrated three electrode pairs (FIG. 10(*a*)), and the group of the three electrode pairs is placed to merge the ion wind generated from a group of the relevant electrode pair (FIG. 10(*b*)). Herein, it is preferable that the electrodes are placed such that the ion winds generated from the respective electrode pairs are concentrated on one point. That is, the electrodes may be placed at an angle to concentrate the ion wind generated from the electrode pair located at the center of the top and bottom stages, so that the ion winds generated from the respective electrode pairs can be merged and thus a large volume of ion wind can be obtained.

The ion/ozone generating device according to the present invention may be used not only as a sterilizing/deodorizing device, but also as an ionized water/sterilized water generating device.

Since the device according to the present invention generates ions and/or ozone by corona discharge and also generates a large volume of ion wind, they are carried by the ion wind and contacted by a sterilizing/deodorizing target object, so that the device can be used as an ion/ozone generating device. Further, since a large volume of ion wind is generated, ions and ozone are generated and sent out to a space where a sterilizing/deodorizing target object is placed without using a pump. Accordingly, the device can be used as an external sterilizing/deodorizing device.

When the ion/ozone wind generation device according to the present invention can also be used to sterilize/deodorize seawater and freshwater based on air stone/nano-bubble air supply. That is, since a nano-bubbler generator requires air injection, the ion wind guide member and the blower path are combined to use as a nano-bubble air supply source, so that the ion/ozone wind is reacted in water to simply generate ionized water/sterilized water. Accordingly, the device can be used for the purpose of beauty such as a whitening effect using a bleaching action being the characteristics of ozone, or to remove fat from the base of pores by the sterilizing/cleansing of a skin using a synergy effect of ozone water and nano-bubbles. Further, the device can be used to sterilize/deodorize an aquarium for breeding fish and shellfish, to sterilize a culture fluid for hydroponic cultivation, to generate sterilized water in kitchen using a discharge pressure of a tap water as a power source, and to inexpensively and safely perform effective sterilization/deodorization or resolution of fat by ozone water.

The invention claimed is:

1. An ion/ozone wind generation device comprising an electrode pair including a needle-shaped electrode and an opposite electrode, for generating ions and ion/ozone wind using corona discharge by generating a potential difference between the needle-shaped electrode and the opposite electrode, wherein the opposite electrode includes a plane-shaped main ring-shaped opposite electrode and a plane-shaped sub ring-shaped opposite electrode surrounding the plane-shaped main ring-shaped opposite electrode, and a longest distance between a tip of the needle-shaped electrode and the main ring-shaped opposite electrode is shorter than a shortest distance between the tip of the needle-shaped electrode and the sub ring-shaped opposite electrode.

2. The ion/ozone wind generation device according to claim 1, comprising:

an ion wind guide member that concentrates ion wind generated from the sub ring-shaped opposite electrode, with respect to ion wind generated from the main ring-shaped opposite electrode of the opposite electrode, and sends the ion wind to an exhaust nozzle that exhausts out the ion wind to the outside, wherein a cross-sectional area of an opening of the ion wind guide member decreases toward the exhaust nozzle.

3. The ion/ozone wind generation device according to claim 1, comprising a plurality of the electrode pairs.

4. The ion/ozone wind generation device according to claim 2, comprising a plurality of the electrode pairs.

* * * * *